US008869999B2

(12) United States Patent
Lindo et al.

(10) Patent No.: US 8,869,999 B2
(45) Date of Patent: Oct. 28, 2014

(54) CURTAIN ROD END CAP AND COVER

(71) Applicant: Zenith Products Corporation, New Castle, DE (US)

(72) Inventors: Benjamin G. Lindo, Philadelphia, PA (US); Kaveh Didehvar, Hockessin, DE (US)

(73) Assignee: Zenith Products Corporation, New Castle, DE (US)

( * ) Notice: Subject to any disclaimer, the term of this patent is extended or adjusted under 35 U.S.C. 154(b) by 0 days.

(21) Appl. No.: 13/752,724

(22) Filed: Jan. 29, 2013

(65) Prior Publication Data

US 2013/0200024 A1 Aug. 8, 2013

Related U.S. Application Data

(60) Provisional application No. 61/595,355, filed on Feb. 6, 2012.

(51) Int. Cl.
*A47H 1/00* (2006.01)
*A47H 1/02* (2006.01)

(Continued)

(52) U.S. Cl.
CPC ..... *A47H 1/022* (2013.01); *A47H 1/122* (2013.01); *A47H 1/102* (2013.01); *A47K 3/38* (2013.01); *A47H 1/142* (2013.01)
USPC ..... 211/105.3; 211/123

(58) Field of Classification Search
CPC ... A47G 25/0692; A47H 1/022; A47H 1/122; A47H 1/102; A47H 1/142; A47H 1/08; A47H 1/18; A47H 1/00; A47H 1/02; A47H 1/10; A47H 1/12; A47H 1/14; A47H 2001/00; A47H 2001/003; A47H 2001/02; A47H 2001/0215; A47K 3/38; A47K 3/30; A47K 10/04; A47K 10/10; F16B 7/1463; F16B 7/06; F16B 37/0864; F16B 7/1427; F16B 7/14; E06B 9/323; E06B 9/266; A47F 5/0823; A47F 5/0006; A47B 61/003; A47B 96/1441
USPC ..... 211/105.1, 105.6, 107, 123, 211/105.2–105.5, 6, 16, 88.04; 248/200.1, 248/251, 261, 262, 264; 4/610, 558; 16/874 R, 87.2, 87 R, 94 R
See application file for complete search history.

(56) References Cited

U.S. PATENT DOCUMENTS

D19,582 S 1/1890 Lau
653,642 A 7/1900 Darling (Continued)

FOREIGN PATENT DOCUMENTS

CH 625601 A5 9/1981
CN 2221357 Y 3/1996

(Continued)

OTHER PUBLICATIONS

<http://plumbing.hardwarestore.com/51-283-shower-rods-and-holders/stanless-steel-curved-shower-rod-609421.aspx>; Stanless Steel Curved Shower Rod, 1"×5"; web page printout date: Feb. 10, 2010; original web posting date: unknown, 1 page. (admitted prior art).

(Continued)

*Primary Examiner* — Jennifer E Novosad
(74) *Attorney, Agent, or Firm* — Panitch Schwarze Belisario & Nadel LLP

(57) ABSTRACT

A rod assembly includes a rod having a first rod section telescopingly received with a second rod section, first and second end caps, and first and second covers. Each end cap has an open first end, a generally closed second end, and a groove which extends around an external periphery of the end cap proximate the generally closed second end. Each cover has a cavity extending between a generally open first end and an opposing second end. The cavity has a flange which extends around an interior periphery of the cavity at an open end of the cavity. The cavity of each cover is sized and shaped to receive at least a portion of one of the first and second end caps therein such that the external peripheral groove of the end cap engages the internal peripheral flange of the cover.

19 Claims, 6 Drawing Sheets

(51) Int. Cl.

| | |
|---|---|
| ***A47H 1/08*** | (2006.01) |
| ***A47K 10/04*** | (2006.01) |
| ***A47H 1/022*** | (2006.01) |
| ***A47H 1/122*** | (2006.01) |
| ***A47H 1/102*** | (2006.01) |
| ***A47K 3/38*** | (2006.01) |
| ***A47H 1/142*** | (2006.01) |

(56) References Cited

U.S. PATENT DOCUMENTS

| | | | | | |
|---|---|---|---|---|---|
| 839,959 | A | | 1/1907 | Richards | |
| 1,481,730 | A | * | 1/1924 | Oakley | 211/123 |
| 1,502,154 | A | | 7/1924 | Meuller | |
| 1,675,111 | A | | 6/1928 | Kenney | |
| 1,679,881 | A | | 8/1928 | Simpson | |
| 1,721,305 | A | * | 7/1929 | Koering | 211/123 |
| 1,721,306 | A | * | 7/1929 | Koering | 211/123 |
| D81,134 | S | | 5/1930 | Henderson | |
| 1,837,340 | A | * | 12/1931 | Schwartz | 211/105.4 |
| 1,951,660 | A | | 3/1934 | Klaudt | |
| 1,953,450 | A | | 4/1934 | Thompson | |
| 2,131,156 | A | | 9/1938 | Yardley | |
| 2,150,204 | A | | 3/1939 | Boye | |
| D119,576 | S | | 3/1940 | Kirsch | |
| 2,194,064 | A | | 3/1940 | Boye | |
| 2,195,979 | A | | 4/1940 | Ziolkowski | |
| 2,215,331 | A | | 9/1940 | Marsh | |
| 2,219,075 | A | | 10/1940 | Veau | |
| 2,250,003 | A | | 7/1941 | Boye | |
| 2,293,168 | A | | 8/1942 | Pirone | |
| 2,383,104 | A | | 8/1945 | Allen | |
| 2,458,643 | A | | 1/1949 | Riley | |
| 2,462,321 | A | | 2/1949 | Holmes | |
| 2,519,996 | A | | 8/1950 | Blake | |
| 2,562,371 | A | | 7/1951 | Shannon | |
| 2,637,555 | A | * | 5/1953 | Klaudt | 482/40 |
| 2,778,030 | A | | 1/1957 | Goche | |
| 2,796,227 | A | | 6/1957 | Coakley | |
| 2,915,327 | A | | 12/1959 | Kreske | |
| 2,919,134 | A | | 12/1959 | Zuro | |
| 2,974,806 | A | * | 3/1961 | Seewack | 211/123 |
| 3,023,909 | A | | 3/1962 | Henry | |
| 3,079,005 | A | | 2/1963 | Bednar | |
| 3,107,361 | A | | 10/1963 | Glutting, Sr. | |
| 3,418,665 | A | | 12/1968 | Long | |
| 3,429,452 | A | | 2/1969 | Johnson | |
| 3,493,121 | A | | 2/1970 | Doyle | |
| 3,504,805 | A | | 4/1970 | Doyle | |
| 3,521,758 | A | | 7/1970 | Guilfoyle, Sr. | |
| 3,557,390 | A | | 1/1971 | Ruggles et al. | |
| 3,572,511 | A | | 3/1971 | Triplett | |
| 3,687,499 | A | | 8/1972 | Guilfoyle, Sr. | |
| 3,864,760 | A | | 2/1975 | Bowen | |
| D248,434 | S | | 7/1978 | Clivio et al. | |
| 4,117,557 | A | | 10/1978 | McPeak et al. | |
| 4,229,842 | A | | 10/1980 | Gilmore | |
| 4,238,164 | A | | 12/1980 | Mazzolla | |
| 4,329,076 | A | * | 5/1982 | Coreth | 403/109.8 |
| 4,378,071 | A | | 3/1983 | Yakimicki | |
| 4,399,917 | A | | 8/1983 | Ohman | |
| 4,461,056 | A | | 7/1984 | Solinski | |
| 4,496,059 | A | | 1/1985 | Leiter | |
| 4,586,615 | A | | 5/1986 | Quitmann | |
| 4,636,106 | A | * | 1/1987 | Waisbrod | 403/228 |
| D293,297 | S | | 12/1987 | Wood | |
| 4,754,504 | A | | 7/1988 | Cellini | |
| 4,809,401 | A | | 3/1989 | Honig | |
| D301,976 | S | | 7/1989 | Greenhut et al. | |
| 4,895,471 | A | | 1/1990 | Geltz et al. | |
| 5,022,104 | A | | 6/1991 | Miller | |
| 5,056,753 | A | | 10/1991 | Lunau et al. | |
| 5,103,531 | A | | 4/1992 | Perrotta | |
| D327,421 | S | | 6/1992 | Pagan | |
| 5,189,759 | A | | 3/1993 | Poore | |
| 5,216,766 | A | | 6/1993 | Lang | |
| 5,236,229 | A | | 8/1993 | Gonzalez | |
| 5,242,065 | A | | 9/1993 | Hoban | |
| 5,263,594 | A | | 11/1993 | Bianchi | |
| 5,281,063 | A | | 1/1994 | Austin, III | |
| D347,784 | S | | 6/1994 | Warshawsky | |
| 5,330,061 | A | | 7/1994 | Geltz | |
| 5,433,551 | A | | 7/1995 | Gordon | |
| 5,477,964 | A | | 12/1995 | Hart | |
| 5,484,056 | A | | 1/1996 | Wood | |
| D374,167 | S | | 10/1996 | Scholl | |
| 5,561,870 | A | | 10/1996 | Hertel | |
| D376,312 | S | | 12/1996 | Cahn et al. | |
| D377,753 | S | | 2/1997 | Meadows | |
| D379,297 | S | | 5/1997 | Shires | |
| 5,662,297 | A | | 9/1997 | Christensen et al. | |
| D385,177 | S | | 10/1997 | Perry | |
| 5,678,703 | A | * | 10/1997 | Sawyer | 211/105.1 |
| D393,390 | S | | 4/1998 | Gottwald | |
| D397,928 | S | | 9/1998 | Wise | |
| 5,803,643 | A | | 9/1998 | Patelli et al. | |
| 5,876,147 | A | | 3/1999 | Longo | |
| 5,894,610 | A | | 4/1999 | Winter | |
| D416,785 | S | | 11/1999 | Ming-Hsiao | |
| D426,142 | S | | 6/2000 | Moore | |
| D429,461 | S | | 8/2000 | Rowlay | |
| 6,101,675 | A | | 8/2000 | Goldstein | |
| D431,460 | S | | 10/2000 | Nichol | |
| D438,462 | S | | 3/2001 | Nichol | |
| 6,216,287 | B1 | | 4/2001 | Wise | |
| 6,263,523 | B1 | | 7/2001 | Moore | |
| 6,302,180 | B1 | * | 10/2001 | Yu | 160/38 |
| 6,302,614 | B1 | | 10/2001 | Tseng | |
| D466,399 | S | | 12/2002 | Jessee et al. | |
| 6,543,629 | B1 | | 4/2003 | Samelson | |
| 6,640,395 | B2 | | 11/2003 | Bush | |
| 6,651,831 | B2 | * | 11/2003 | Samelson | 211/105.3 |
| D483,251 | S | | 12/2003 | Suero, Jr. | |
| 6,694,543 | B2 | | 2/2004 | Moore | |
| 6,715,163 | B1 | | 4/2004 | Cunningham | |
| D489,249 | S | | 5/2004 | Moore | |
| 6,745,909 | B1 | | 6/2004 | Lai | |
| D498,663 | S | | 11/2004 | Moore | |
| 6,824,000 | B2 | | 11/2004 | Samelson | |
| 6,845,955 | B1 | | 1/2005 | Hsu | |
| 6,862,776 | B2 | | 3/2005 | Chen | |
| 6,883,664 | B2 | | 4/2005 | Lee | |
| D506,920 | S | | 7/2005 | Taylor | |
| 6,913,156 | B1 | * | 7/2005 | Wolff | 211/184 |
| 7,024,706 | B2 | | 4/2006 | Hess | |
| D522,845 | S | | 6/2006 | Suero | |
| D522,846 | S | | 6/2006 | Suero, Jr. | |
| D522,847 | S | | 6/2006 | Suero, Jr. | |
| 7,055,680 | B2 | | 6/2006 | Liebers | |
| D525,115 | S | | 7/2006 | Harwanko | |
| 7,076,815 | B2 | | 7/2006 | Orpilla | |
| 7,111,336 | B1 | | 9/2006 | Lai | |
| D534,062 | S | | 12/2006 | van den Bosch | |
| D542,125 | S | | 5/2007 | Kaminski | |
| D542,897 | S | | 5/2007 | Harwanko | |
| D543,754 | S | | 6/2007 | Bauer et al. | |
| D543,756 | S | | 6/2007 | Gilbert | |
| D543,839 | S | | 6/2007 | Cooper et al. | |
| D544,786 | S | | 6/2007 | Barrese | |
| D547,165 | S | | 7/2007 | Barrese | |
| D550,542 | S | | 9/2007 | Worrall et al. | |
| D552,455 | S | | 10/2007 | Moore | |
| 7,296,772 | B2 | | 11/2007 | Wang | |
| D557,590 | S | | 12/2007 | Moore | |
| D563,209 | S | | 3/2008 | Samelson | |
| D563,526 | S | | 3/2008 | Bauer | |
| D565,937 | S | | 4/2008 | Tsai | |
| D567,637 | S | | 4/2008 | Moore | |
| D576,022 | S | | 9/2008 | Goldstein | |
| D577,991 | S | | 10/2008 | Chen | |
| D586,647 | S | | 2/2009 | Didehvar | |
| 7,512,997 | B2 | | 4/2009 | Dewees | |
| 7,597,297 | B2 | | 10/2009 | Isfeld et al. | |
| D618,542 | S | | 6/2010 | Bertken | |

(56) References Cited

U.S. PATENT DOCUMENTS

| | | | | |
|---|---|---|---|---|
| 7,762,508 | B2 | 7/2010 | Xu | |
| D624,807 | S | 10/2010 | Barrese | |
| D624,808 | S | 10/2010 | Krawczak et al. | |
| 7,857,151 | B2 | 12/2010 | Barrese | |
| D631,273 | S | 1/2011 | O'Brien et al. | |
| D631,732 | S | 2/2011 | Krawczak et al. | |
| D633,780 | S | 3/2011 | Barrese | |
| D634,609 | S | 3/2011 | Bauer | |
| D636,660 | S | 4/2011 | O'Connell | |
| 7,926,127 | B2 | 4/2011 | Barrese | |
| 7,950,534 | B2 | 5/2011 | Kao | |
| D640,078 | S | 6/2011 | Gilbert | |
| 7,958,577 | B2 | 6/2011 | Chang | |
| 7,987,532 | B2 | 8/2011 | Bathurst et al. | |
| 7,987,534 | B2 | 8/2011 | Lin | |
| 7,997,428 | B2 * | 8/2011 | Goldstein | 211/105.3 |
| 8,015,633 | B2 | 9/2011 | Ho | |
| D648,619 | S | 11/2011 | Lowe | |
| D648,834 | S | 11/2011 | Gilbert | |
| 8,056,873 | B1 | 11/2011 | Hanley et al. | |
| D650,263 | S | 12/2011 | Barrese | |
| 8,069,507 | B2 | 12/2011 | Didehvar et al. | |
| 8,069,508 | B2 | 12/2011 | O'Connell | |
| 8,146,182 | B2 | 4/2012 | Bauer | |
| 8,185,981 | B2 | 5/2012 | Didehvar et al. | |
| 8,214,938 | B2 * | 7/2012 | Hanley et al. | 4/610 |
| 8,215,501 | B2 | 7/2012 | Trettin et al. | |
| 8,215,863 | B2 | 7/2012 | Sohn | |
| D667,295 | S | 9/2012 | Harwanko | |
| 8,297,870 | B2 | 10/2012 | Lenhart | |
| D671,395 | S | 11/2012 | Harwanko | |
| 8,341,775 | B2 | 1/2013 | Didehvar | |
| 8,505,129 | B2 * | 8/2013 | Parker et al. | 4/610 |
| 8,505,749 | B2 | 8/2013 | Trettin et al. | |
| 8,522,373 | B2 | 9/2013 | Bauer | |
| D691,030 | S | 10/2013 | Lindo et al. | |
| 2003/0034316 | A1 | 2/2003 | Kao | |
| 2003/0052070 | A1 | 3/2003 | Weisenburger | |
| 2004/0178310 | A1 | 9/2004 | Marion | |
| 2004/0182806 | A1 | 9/2004 | Figueroa | |
| 2005/0053423 | A1 | 3/2005 | Doubler et al. | |
| 2005/0230587 | A1 | 10/2005 | Yang | |
| 2005/0268394 | A1 | 12/2005 | Monk et al. | |
| 2006/0070177 | A1 | 4/2006 | Bathurst et al. | |
| 2006/0156465 | A1 | 7/2006 | Lavi et al. | |
| 2006/0218717 | A1 | 10/2006 | van den Bosch | |
| 2007/0006377 | A1 | 1/2007 | Moore | |
| 2007/0006378 | A1 | 1/2007 | Moore | |
| 2007/0174956 | A1 | 8/2007 | Heaslip | |
| 2008/0022451 | A1 | 1/2008 | Urlich et al. | |
| 2008/0028513 | A1 | 2/2008 | Didehvar | |
| 2008/0115265 | A1 | 5/2008 | Heaslip | |
| 2008/0184479 | A1 | 8/2008 | Bathurst | |
| 2008/0210827 | A1 | 9/2008 | Samelson | |
| 2008/0245486 | A1 | 10/2008 | Brown | |
| 2008/0245940 | A1 | 10/2008 | Brown | |
| 2008/0282464 | A1 | 11/2008 | Bauer | |
| 2008/0289096 | A1 | 11/2008 | Patel | |
| 2009/0083905 | A1 | 4/2009 | O'Connell | |
| 2011/0011813 | A1 | 1/2011 | Kao | |
| 2011/0113547 | A1 | 5/2011 | O'Connell | |
| 2012/0005823 | A1 | 1/2012 | Baines | |
| 2012/0023657 | A1 | 2/2012 | Didehvar et al. | |
| 2012/0036628 | A1 | 2/2012 | O'Connell | |
| 2012/0110729 | A1 | 5/2012 | Baines | |
| 2012/0152872 | A1 | 6/2012 | Didehvar | |
| 2012/0152873 | A1 | 6/2012 | Didehvar | |
| 2012/0152874 | A1 | 6/2012 | Didehvar | |
| 2012/0167368 | A1 | 7/2012 | Napier et al. | |
| 2012/0241399 | A1 | 9/2012 | Trettin et al. | |
| 2012/0284914 | A1 | 11/2012 | Bauer | |
| 2012/0285914 | A1 | 11/2012 | Carney | |

FOREIGN PATENT DOCUMENTS

| | | | |
|---|---|---|---|
| CN | 2228573 | Y | 6/1996 |
| CN | 2349932 | Y | 11/1999 |
| CN | 2566754 | Y | 8/2003 |
| CN | 2835679 | Y | 11/2006 |
| CN | 2893271 | Y | 4/2007 |
| CN | 2902096 | Y | 5/2007 |
| CN | 201001603 | Y | 1/2008 |
| CN | 201189069 | Y | 2/2009 |
| CN | 201363343 | Y | 12/2009 |
| GB | 2325397 | A | 11/1998 |
| GB | 2400813 | A | 10/2004 |
| GB | 2426693 | A | 12/2006 |
| JP | 2000-046021 | A | 2/2000 |
| JP | 2001-112561 | A | 4/2001 |
| JP | 2004-036803 | A | 2/2004 |
| JP | 2004-057213 | A | 2/2004 |

OTHER PUBLICATIONS

Office Action issued Jul. 8, 2011 in U.S. Appl. No. 11/833,044.
U.S. Appl. No. 13/253,617, filed Oct. 5, 2011.
Office Action issued Dec. 11, 2012 in U.S. Appl. No. 29/381,234.
Notice of Allowance issued Jul. 24, 2012 in U.S. Appl. No. 29/422,283.
U.S. Appl. No. 29/398,880 by Lindo, filed Aug. 5, 2011.
Office Action issued Feb. 16, 2012 in U.S. Appl. No. 13/253,617.
U.S. Appl. No. 29/381,234 by Didehvar, filed Dec. 16, 2010.
U.S. Appl. No. 29/390,736 by Harwanko, filed Apr. 28, 2011.
U.S. Appl. No. 13/676,800 by Didehvar, filed Nov. 14, 2012.
U.S. Appl. No. 13/676,802 by Didehvar, filed Nov. 14, 2012.
Office Action issued Jul. 20, 2011 in U.S. Appl. No. 12/157,376.
Office Action issued Nov. 22, 2011 in U.S. Appl. No. 12/157,376.
U.S. Appl. No. 29/437,013 by Didehvar, filed Nov. 12, 2012.
U.S. Appl. No. 29/443,578 by Lindo, filed Jan. 18, 2013.
<http://www.amazon.com/Polder-Radial-Duo-Shower-Rod/dp/B001CEONRY>; Polder Radial Duo Shower Rod, web page printout date: Jun. 2, 2011; original web posting date and product availability date: unknown, 3 pages. (admitted prior art).
U.S. Appl. No. 29/398,881 by Walker, filed Aug. 5, 2011.
Photograph of Curved Shower Rod by Hardware Resources (admitted prior art).
Photograph of a curved shower rod distributed by Popular Bath Products, Inc. (admitted prior art).
Office Action issued Dec. 14, 2012 in U.S. Appl. No. 13/269,108.
Three photographs of Maytex Mills "EZ-Up" tension rod (date unknown) (admitted prior art).
Photographs of Tension Rod With End Cap and Cover (1)—Date Unknown—Admitted Prior Art.
Photographs of Tension Rod With End Cap and Cover (2)—Date Unknown—Admitted Prior Art.
Office Action issued Oct. 4, 2013 in U.S. Appl. No. 13/268,712 by Didehvar.
Office Action issued Oct. 11, 2013 in U.S. Appl. No. 13/269,030 by Didehvar.
Office Action issued Apr. 2, 2013 in U.S. Appl. No. 29/437,013.
U.S. Appl. No. 29/451,499 by Harwanko, filed Apr. 3, 2013.
U.S. Appl. No. 13/911,191 by Didefivar, filed Jun. 6, 2013.
Office Action issued Jul. 8, 2013 in U.S. Appl. No. 13/269,108 by Didehvar.
Office Action issued Nov. 29, 2013 in U.S. Appl. No. 13/268,712 by Didehvar.
Office Action issued Dec. 6, 2013 in U.S. Appl. No. 13/269,108 by Didehvar.
U.S. Appl. No. 14/258,546 by Vaccaro, filed Apr. 22, 2014.
Office Action issued Jul. 2, 2014 in U.S. Appl. No. 13/269,108 by Didehvar.

* cited by examiner

CURTAIN ROD END CAP AND COVER

CROSS-REFERENCE TO RELATED APPLICATIONS

This application claims the benefit of U.S. Provisional Patent Application No. 61/595,355, filed Feb. 6, 2012, entitled "Tension Rod with End Cap," the entire disclosure of which is incorporated herein by reference.

BACKGROUND OF THE INVENTION

The present invention generally relates to a curtain rod end cap. More particularly, the present invention relates to an end cap and a cover for a tension-mounted shower rod. The cover is readily interchangeable and can be easily replaced. More particularly, the end cap can be easily positioned on a rod and the cover can be quickly and easily positioned on and removed from the rod without the need for removal of the end cap.

Conventional tension-mounted shower rod assemblies include a shower rod mounted between two shower walls by the application of compressive forces supplied by the tension-mounted rod and applied to the shower walls. Such conventional tension-mounted rod assemblies are well known in the art. To aid in keeping the tension-mounted shower rod fixed in position, such conventional assemblies also typically include some form of end cap made from a high friction material, such as an elastomer. The end caps cover the ends of the tension-mounted rod and engage the shower walls.

Additionally, conventional tension-mounted shower rod assemblies typically include end covers for aesthetic purposes. More particularly, the end covers cover (and hide from view) the ends of the rods with the end cap positioned thereon. The end covers are dimensioned to slide onto opposing ends the tension-mounted rod without any significant gap therebetween. That is, the inner diameters of the end covers are of the same or similar dimensions to the outer diameter of the rods. However, the overall outer diameter of each end cap is typically greater than that of the tension-mounted rod itself. As such, assembly of the end cover onto the tension-mounted rod can be difficult, thereby necessitating the need for a more complex design for the end cover.

For example, as shown in FIGS. 1A and 1B, a conventional tension-mounted shower rod assembly 100 includes a tension-mounted rod 104, an end cap 102 and an end cover 106. An end cap 102 is positioned on each of the opposing ends of the tension-mounted rod 104. The end cap 102 has a larger overall diameter than that of the tension-mounted rod 104. Thus, in order to assemble the cover 106 onto the tension-mounted rod 104, the end cap 102 must first be removed from the tension-mounted rod 104. After the end cap 102 is removed, the cover 106 can be properly positioned on the end of the tension-mounted rod 104. Then, after the cover 106 is properly positioned, the end cap 102 must then be repositioned back onto the tension-mounted rod 104. Thus, it can be rather complex and time consuming to assemble such conventional tension-mounted shower rod assemblies. In particularly, it can be difficult and time consuming to temporarily remove the end cap 102 in order to assemble the cover 106 on the rod 104.

Therefore, a need exits for a simple and efficient end cap which can be easily assembled onto a tension-mounted curtain rod such as a tension-mounted shower rod. This need is satisfied by the present end cap.

In accordance with the present invention, the problem of providing an easily assembling interchangeable end cover onto a tension rod is solved by engendering a tension shower rod having an end cover and end cap with cooperating detents about a distal end of the end cover that releasably hold the end cap at a fixed position about the end cover. Further, the end cap is sized so as to easily receive the end cover within an interior of the end cap.

BRIEF SUMMARY OF THE INVENTION

Briefly stated, one embodiment of the present invention is directed to a rod assembly comprising a rod including a first rod section that is at least partially tubular and a second rod section that is at least partially tubular, first and second end caps, and first and second covers. The first rod section is telescopingly received with the second rod section. Each end cap has an open first end, an opposing generally closed second end, a sidewall extending therebetween, a recess defined by the sidewall and the generally closed end, and a groove which extends around an external periphery of the end cap proximate the generally closed second end. The recess of each end cap is sized and shaped to receive at least a portion of one of the first and second rod sections therein. Each cover has a generally open first end, an opposing second end and a cavity extending therebetween. The cavity has an open first end, an open second end, and a flange which extends around an interior periphery of the cavity at the open second end of the cavity. The cavity of each cover is sized and shaped to receive at least a portion of one of the first and second end caps therein such that the external peripheral groove of the end cap engages the internal peripheral flange of the cover.

Another embodiment of the present invention is directed to a rod assembly comprising a rod including a first rod section that is at least partially tubular and a second rod section that is at least partially tubular, first and second end caps, and first and second covers. The first rod section is telescopingly received with the second rod section. Each end cap has an open first end, a generally closed second end, a sidewall extending therebetween, a recess defined by the sidewall and the generally closed end, and at least one rib positioned within an interior of the recess between the open first end and the generally closed second end. The recess of each end cap is sized and shaped to receive at least a portion of one of the first and second rod sections therein such that a distal end of the rod section is proximate the at least one rib. Each cover has a generally open first end, a second end and a cavity extending therebetween. The cavity has an open first end and an open second end. The cavity of each cover is sized and shaped to receive at least a portion of one of the first and second end caps therein. The open second end of the cavity is sized and shaped to allow the generally closed second end of the end cap to pass therethrough and to prevent a remainder of the end cap from passing therethrough.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the present invention is not limited to the precise arrangements and instrumentalities shown. In the drawings.

DETAILED DESCRIPTION OF THE INVENTION

Figure 1B:
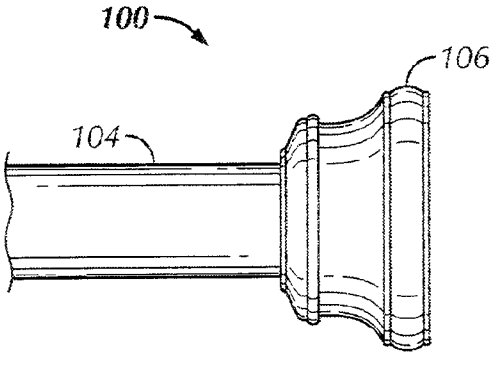
FIG. 1B PRIOR ART
FIG. 1B is a partial side elevational view of the conventional tension-mounted shower rod assembly of FIG. 1A with an end cover fully seated at an end of a tension rod.
Figure 1A:
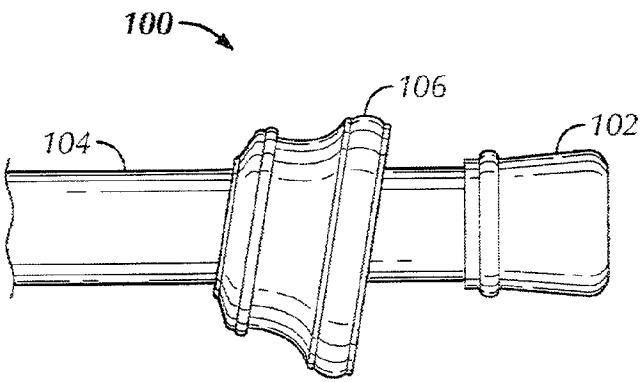
FIG. 1A PRIOR ART
FIG. 1A is a partial side elevational view of a conventional (prior art) tension-mounted shower rod assembly.

Reference will now be made in detail to the present embodiment of the invention illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as "top," "bottom," "above," "below," "upper," "lower," "left," "right," and diagonal, are used with respect to the accompanying drawings. Such directional terms used in conjunction with the following description of the drawings should not be construed to limit the scope of the invention in any manner not explicitly set forth.

The words "first," "second," "third" and "fourth" designate an order of operations in the drawings to which reference is made, but do not limit these steps to the exact order described. The words "inwardly" and "outwardly" refer to directions toward and away from, respectively, the geometric center of the device and designated parts thereof. Unless specifically set forth herein, the terms "a," "an" and "the" are not limited to one element but instead should be read as meaning "at least one." The terminology includes the words noted above, derivatives thereof and words of similar import.

Figure 2:
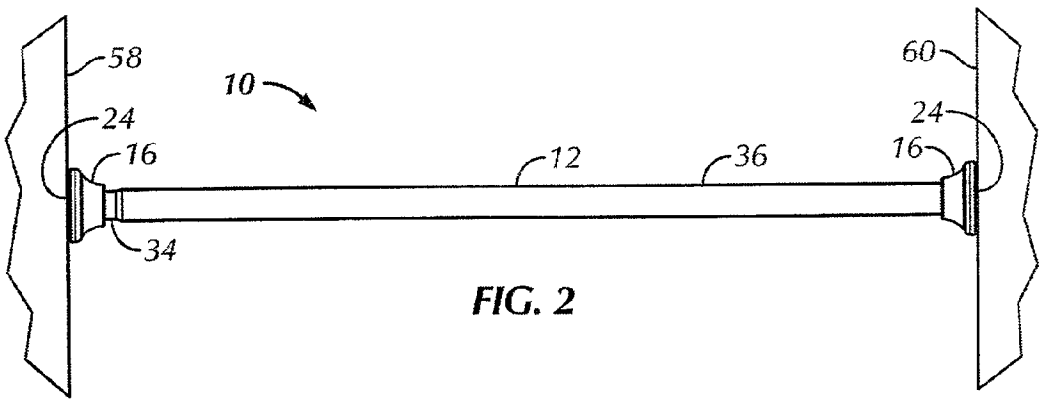
FIG. 2 is a front elevational view of a curtain rod assembly in accordance with a preferred embodiment of the present invention.

Referring to the drawings in detail, there are shown in FIGS. 2-8A preferred embodiments of a rod assembly in accordance with the present invention. With reference initially to FIG. 2, the rod assembly is preferably a tension-mounted assembly which functions as a curtain rod assembly, and more preferably as a shower curtain rod assembly, generally designated 10.

Figure 3:
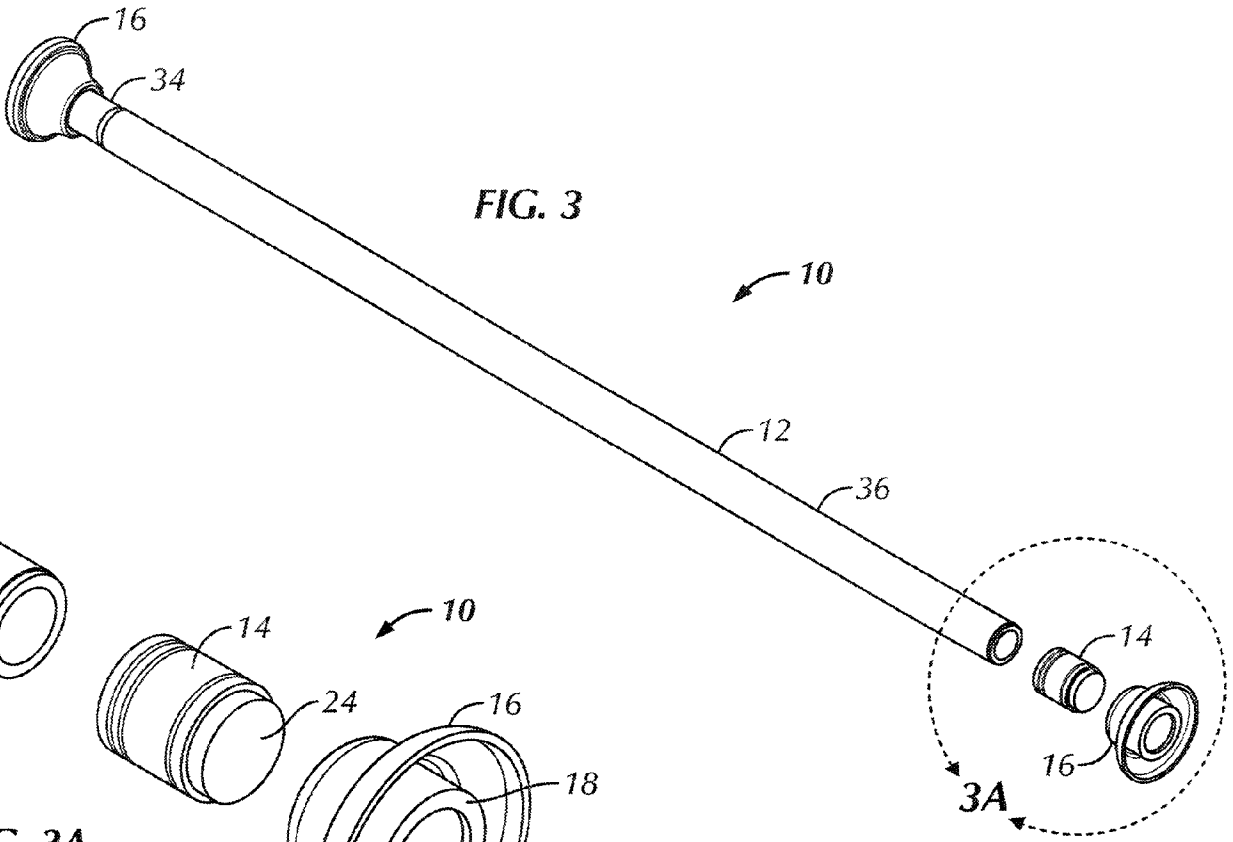
FIG. 3 is partial exploded perspective view of a curtain rod assembly in accordance with a preferred embodiment of the present invention.
Figure 3A:
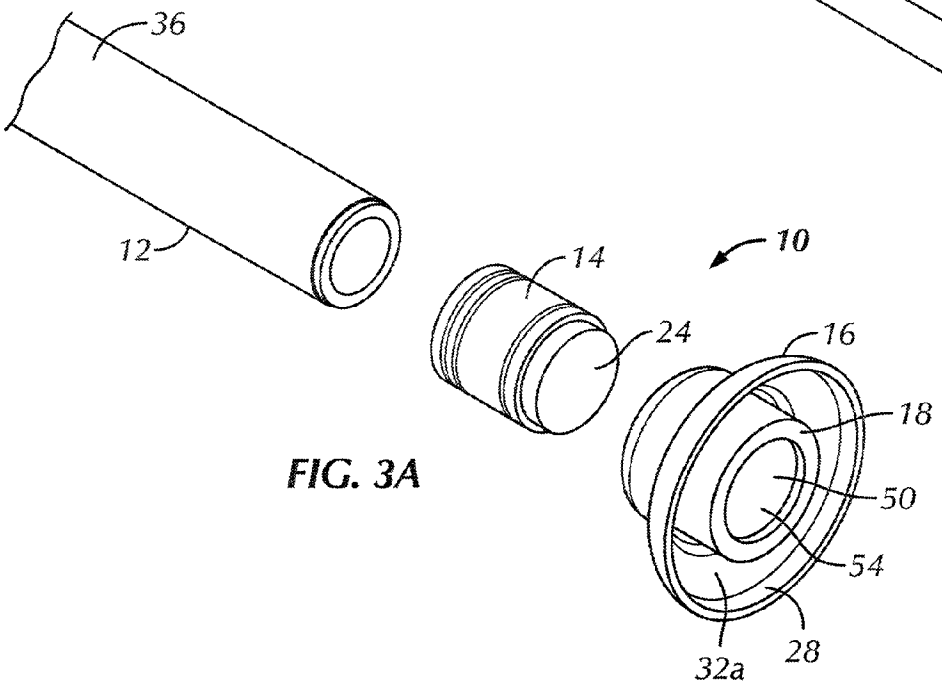
FIG. 3A is an enlarged perspective view of the curtain rod assembly taken about area A of FIG. 3.

Referring to FIGS. 2-3A, the tension-mounted rod assembly 10 includes a rod 12, first and second end caps 14, and first and second covers 16. The rod 12 can be any conventional rod well known in the art. More preferably, the rod 12 is a tension-mounted rod and may be any one of several conventional tension-mounted rods well known in the art. As such, a detailed discussion of the structure and function of the tension-mounted rod 12 is not necessary for a complete understanding of the present invention. However, an exemplary tension-mounted rod applicable to the present invention is disclosed in U.S. Pat. No. 6,824,000, the entire disclosure of which is hereby incorporated by reference herein.

Additionally, an exemplary tension-mounted rod 12 includes first and second rod sections 34, 36 each of which is at least partially tubular and at least partially hollow. More preferably, each of the first and second rod sections 34, 36 is of a completely tubular configuration and is completely hollow. At least a portion of each of the first and second tubular sections 34, 36 also preferably has a generally straight configuration. More preferably, the entirety of each of the first and second rod sections 34, 36 has a generally straight configuration. The first rod section 34 has an outer diameter that is at least slightly smaller than the inner diameter of the second rod section 36, such that the first rod section 34 is telescopingly received within an interior of the second rod section 36. When the rod sections 34, 36 are so telescopically arranged, a distal end of the first rod section 34 forms a first distal (or free) end of the rod 12 and a distal end of the second rod section 36 forms a second distal (or free) end of the rod 12.

The overall length of the rod 12 is adjusted by rotating one of the rod sections 34, 36 in a first direction relative to the other which, in turn, causes the rod sections 34, 36 to move toward each other or in a second direction which causes the rod sections 34, 36 to move away from each other via an appropriate mechanical means.

Also, a tension mechanism (not shown) is preferably fitted within the hollow portions of the first and second rod sections 34, 36. Thus, as the rod 12 is mounted between two vertically-oriented opposing support surfaces 58, 60 (e.g., opposing surfaces of a shower stall or bathtub enclosure), the first and second rod sections 34, 36 apply tension or compressive forces to the opposing support surfaces 58, 60, thereby fixating the rod assembly 10 in place between the two opposing surfaces without the use of fasteners or adhesives. U.S. Pat. No. 5,330,061, which is assigned to Zenith Products Corp. and is incorporated herein by reference, describes a preferred embodiment of a tension mechanism of the type for use in the rod assembly 10. However, it will be understood by those skilled in the art that any conventional tension mechanism known in the art or to be developed may be used, as long as it is capable of achieving the functionality described herein.

The first and second rod sections 34, 36 are preferably made from a metal, and more preferably a non-corrosive metal, such as cold-rolled steel, stainless steel, aluminum, chrome or nickel or alloys or combinations thereof, but may also be constructed using wood, plastic, acrylic, or a like strong, lightweight material or a combination of materials. The first and second rod sections 34, 36 may also be coated with any type of known coating for applying a non-corrosive finish to the rod 12.

One end cap 14 covers each distal end of the rod 12, as shown in FIG. 2. The end cap 14 can be made from any high friction material and preferably from an elastomer, preferably rubber. However, it will be understood by those skilled in the art that the end cap 14 may be made of any material that generates sufficient friction between the end cap 14 and the respective support surface 58, 60, such that tension generated by the rod 12 maintains the rod 12 firmly in place. It will also be understood by those skilled in the art that the entire body of the end cap 14 need not be made of such a high friction (i.e., rubber) material. Instead, as long as the distal portion of the end cap 14 which contacts the respective support surface 58, 60 is, at least in part, made of such a high friction (i.e., rubber) material, the remainder of the body of the end cap 14 may be made of any appropriate material, such as a metal, wood, plastic, acrylic, and the like.

Figure 5:
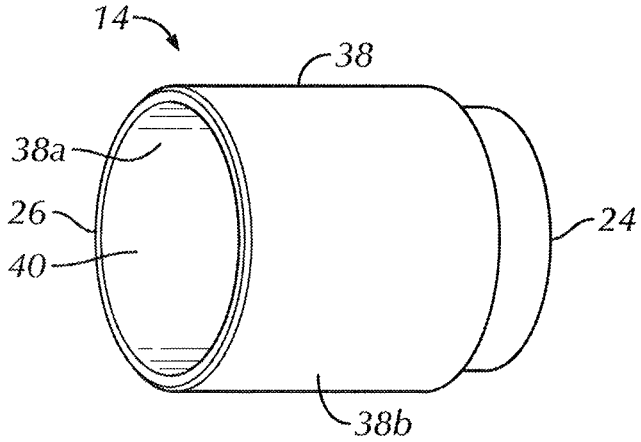
FIG. 5 is a perspective view of an end cap of the curtain rod assembly in accordance with a preferred embodiment of the present invention.
Figure 7C:
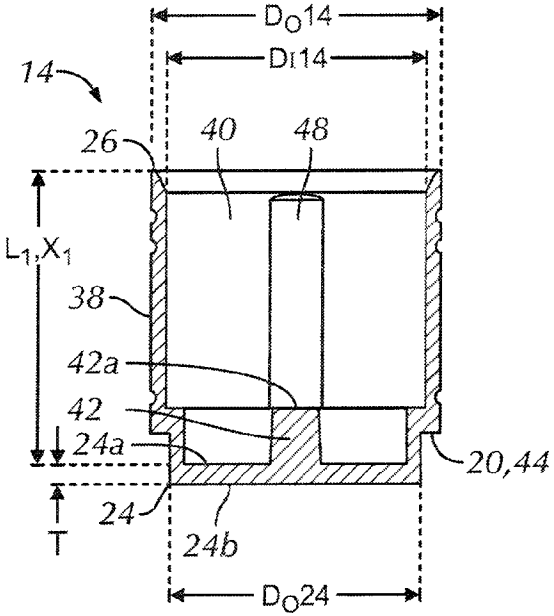
FIG. 7C is a cross-sectional elevational view of the end cap of FIG. 7A.
Figure 7B:
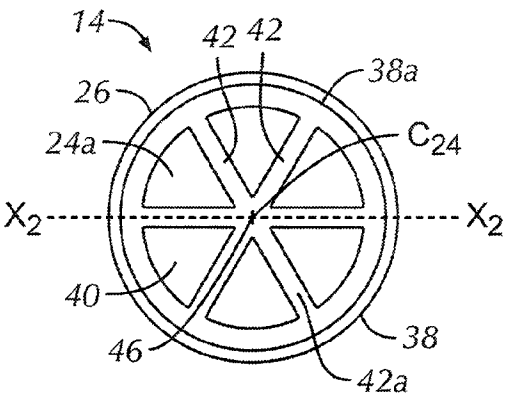
FIG. 7B is a top plan view of the end cap of FIG. 7A.
Figure 7A:
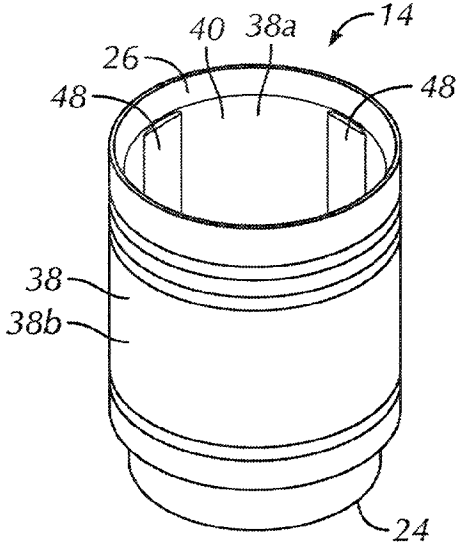
FIG. 7A is a perspective view of an end cap of the curtain rod assembly in accordance with another preferred embodiment of the present invention.

Referring to FIGS. 5 and 7A, in one embodiment, the end cap 14 preferably has an open first (or proximal) end 26, an opposing generally closed second (or distal) end 24, and a sidewall 38 extending therebetween. Preferably, the end cap 14, and more preferably the sidewall 38, has a substantially tubular configuration. However, it will be understood that the end cap 14 and sidewall 38 may have any appropriate shape which complements the shape of the cavity in which the end cap 14 is to be received, as discussed in greater detail below.

Preferably, the second end 24 of the end cap 14 is a completely closed end. However, it will be understood that the second end 24 may include one or more apertures formed therethrough, as long as the second end 24 has a sufficient surface area to bear against a support surface 58, 60 (as discussed in greater detail herein). For ease of understanding, the generally closed second end 24 of the end cap 14 will be referred to herein as "the closed end 24." The closed end 24 of the end cap 14 has an interior surface 24*a* and an exterior surface 24*b* (FIG. 6A).

The sidewall 38 also has an interior surface 38*a* and an exterior surface 38*b*. The interior surface 38*a* of the sidewall 38 and the interior surface 24*a* of the closed end 24 define a recess 40 of the end cap 14. More particularly, the sidewall 38 and the closed end 24 define an interior recess 40 of the end cap 14. Preferably, the recess 40 is sized and shaped to receive at least a portion of one of the first and second rod sections 34, 36 therein. Preferably, the recess 40 has a generally cylindrical configuration. However, it will be understood that the recess 40 may have any appropriate shape which complements the shape of the distal portion of the rod section 34, 36 to be received therein.

Figure 6:
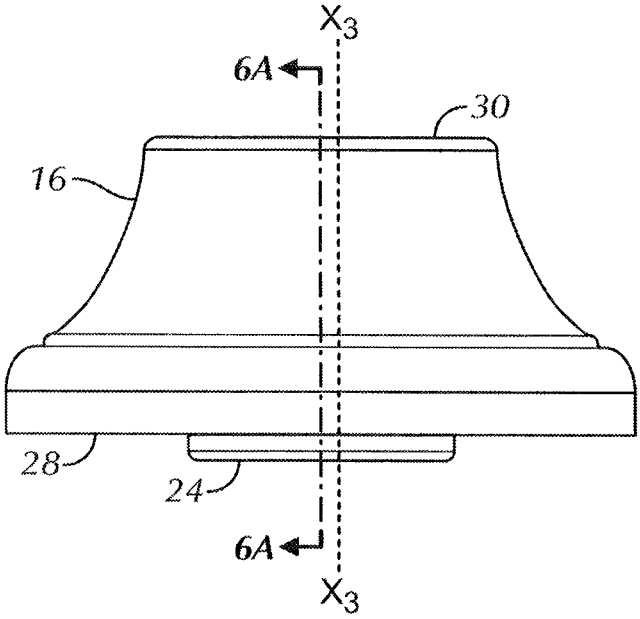
FIG. 6 is a front elevational view of the end cap of FIG. 5 assembled with the end cover of FIG. 4 in accordance with a preferred embodiment of the present invention.
Figure 6A:
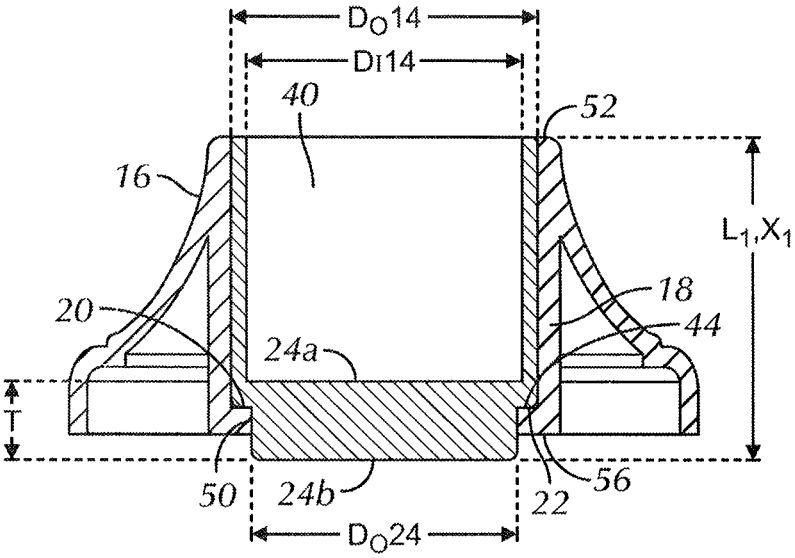
FIG. 6A is a cross-sectional elevational view of the end cap and end cover of FIG. 6 taken along line A-A.

Referring to FIGS. 6A and 7C, a length L of the end cap 14 is defined by the distance between the open end 26 and the exterior surface 24*b* of the closed end 24 along a longitudinal axis $X_1$. Preferably, the overall length L of the end cap 14 extending in the longitudinal direction is relatively short, for example, about 1 to 8 centimeters (i.e., about 0.4 to 3 inches). However, it will be understood by those skilled in the art that the length L of the end cap 14 may vary (i.e., be shorter or longer) depending upon the overall length of the rod 12.

Referring to FIGS. 6A and 7C, the closed end 24 has a thickness T extending from the interior surface 24*a* to the exterior surface 24*b* along the longitudinal axis $X_1$ of the end cap 14. The closed end 24 also preferably has an outer diameter $D_{O24}$ which is at least slightly smaller than an overall outer diameter $D_{114}$ of the end cap 14. More particularly, the outer diameter $D_{O14}$ and the inner diameter $D_{114}$ (i.e., the diameter of the interior cylindrical recess 40) of the end cap 14 remain substantially uniform along the length of the sidewall 38 extending from the open end 26 toward the closed end 24, and more particularly toward the interior surface 24*a* of the closed end 24. However, at a point along the length L of the end cap 14 proximate the interior surface 24*a* of the closed end 24), the end cap 14 transitions to a reduced diameter (i.e., the relatively smaller outer diameter $D_{O24}$ of the closed end 24). A first step or groove 20 is preferably formed at the point of transition proximate the distal closed end 24 of the end cap 14. Preferably, the first stop 20 is configured as a groove 44 which extends around an external periphery of the end cap 14 proximate the closed end 24. More preferably, the external peripheral groove 44 of the end cap 14 extends radially inwardly from the exterior surface 38*b* of the tubular sidewall 38 (or radially outwardly from the closed end 24) proximate the closed distal end 24. Most preferably, the stop 20 is configured as a distally-facing, circumferential groove 44 which is at least slightly spaced apart from the exterior surface 24*b* of the closed end 24, such that the closed end 24 extends or protrudes at least slightly from the surface of the groove 44.

In one embodiment, the closed end 24 of the end cap 14 has a relatively large thickness along the longitudinal axis $X_1$. Preferably, the thickness T of the closed end 24 constitutes approximately ¼ to ½, and more preferably approximately ½ to ⅓, of the overall length L of the end cap 14. Preferably, the thickness T of the closed end 24 extending in the longitudinal direction is about 0.5 to 2 centimeters (i.e., about 0.2 to 0.75 inches).

In another embodiment, the closed end 24 of the end cap 14 has a relatively small thickness along the longitudinal axis $X_1$. Preferably, the thickness T of the closed end 24 constitutes approximately 1/10 to ¼, and more preferably approximately 1/10 to ⅛, of the overall length L of the end cap 14. Preferably, the thickness T of the closed end 24 extending in the longitudinal direction is about 0.1 to 0.5 centimeters (i.e., about 0.04 to 0.2 inches).

FIGS. 5-6A depict the embodiment of the end cap 14 with a relatively thicker closed end 24. FIGS. 7A-8A depict the embodiment of the end cap 14 with a relatively thinner closed end 24. In the embodiment of FIGS. 7A-8A (i.e., end cap 14 having a thinner closed end 24), at least one rib 42 is preferably positioned within an interior of the recess 40 at a location between the open end 26 and the closed end 24. It will be understood that one or more ribs 42 may also be included in an end cap 14 having a relatively thicker closed end 24.

Referring to FIG. 7B, preferably, a plurality of ribs 42 are positioned within the recess 40. In one embodiment, the ribs 42 are positioned on the interior surface 24*a* of the closed end 24 and project inwardly from the interior surface 24*a* into the interior recess 40 of the end cap 14 in the direction of the longitudinal axis $X_1$. More preferably, the ribs 42 are attached to the interior surface 24*a*, and most preferably the ribs 42 are formed integrally with the interior surface 24*a*, of the closed end 24. In another embodiment, the ribs 42 are positioned on the interior surface 38*a* of the sidewall 38 and project inwardly from the interior surface 38*a* into the interior recess 40 of the end cap 14 in a direction of a lateral axis $X_2$ of the end cap 14 which is perpendicular to the longitudinal axis $X_1$. More preferably, in such an embodiment, the ribs 42 are attached to the interior surface 38*a*, and most preferably the ribs 42 are formed integrally with the interior surface 38*a*, of the sidewall 38. In yet another embodiment, the ribs 42 are preferably configured to project from and preferably be integrally formed with both the interior surface 24*a* of the closed end 24 and the interior surface 38*a* of the sidewall 38 (see FIG. 7B).

In one embodiment, the plurality of ribs 42 preferably extend radially outwardly from a central hub 46 toward the tubular sidewall 38. Preferably, the length of each radially extending rib 42 is sufficiently large such that each rib 42 contacts the tubular sidewall 38. More preferably, the ribs 42 are integrally formed with the sidewall 38. The hub 46 is preferably located within the interior recess 40 at a geometric center $C_{24}$ of the closed end 24, and more preferably at a geometric center $C_{24}$ of the closed end 24 along the lateral axis $X_2$. As such, the plurality of ribs 42 are arranged in a hub and spoke configuration. The hub and spoke structure of the ribs 42 is preferably positioned within the interior recess 40 of the end cap 14 proximate the closed end 24. More preferably, distal ends 42*a* of the ribs 42 as positioned within the interior recess 40 and are spaced apart from the interior surface 24*a* of the closed end 24.

Referring to FIGS. 2-3A, each end cap 14 is configured to receive and cover at least a portion of one of the rod sections 34, 36. More preferably, end cap 14 is configured to receive and cover at least a portion of one of the distal ends of the rod 12. More particularly, the recess 40 of each end cap 14 is configured to receive one of the distal ends of the rod 12. Preferably, the inner diameter $D_{114}$ of each end cap 14, and more preferably the diameter of the recess 40, is at least slightly less than the outer diameter of the end of the rod section 34, 36 received therein to achieve a tight friction fit between the end caps 14 and the rod 12.

As discussed above, when the rod 12 is formed of telescoping rod section, the first and second telescoping rod sections 34, 36 have differing diameters. More particularly, the outer diameter of the first rod section 34 will be at least slightly smaller than outer diameter of the second rod section 36. As such, while the structures and configurations of the first and second end caps 14 are identical, the overall dimensions of the end cap 14 differ from each other. For example, the inner diameter $D_{114}$ (i.e., the diameter of the recess 40) and/or the outer diameter $D_{O14}$ of one of the end caps 14 may be smaller than the inner diameter $D_{114}$ and/or the outer diameter $D_{O14}$ of the other end caps 14, such that one end cap 14 is configured to receive a portion of the smaller diameter first rod section 34 therein and the other end cap 14 is configured to receive a portion of the larger diameter second rod section 36 therein.

In one embodiment, the interior surface 38*a* of the tubular sidewall 38 of the end cap 14 is generally smooth (see FIG. 5). In another embodiment, the interior surface 38*a* includes a plurality of spaced apart longitudinally and radially inwardly extending protrusions 48 which facilitate gripping of the rod 12 within the interior recess 40 (see FIG. 7A). More preferably, the spaced-apart protrusions 48 extend longitudinally from the open end 24 of the end cap 14 toward the closed end 24 and are formed integrally with the interior surface 38*a* of the sidewall 38.

Once an end cap 14 is properly positioned on each of the two distal ends of the rod 12, the cover 16 can then be assembled onto the end cap 14. More particularly, the cover 16 may be slid directly onto and over the end cap 14.

Figure 4:
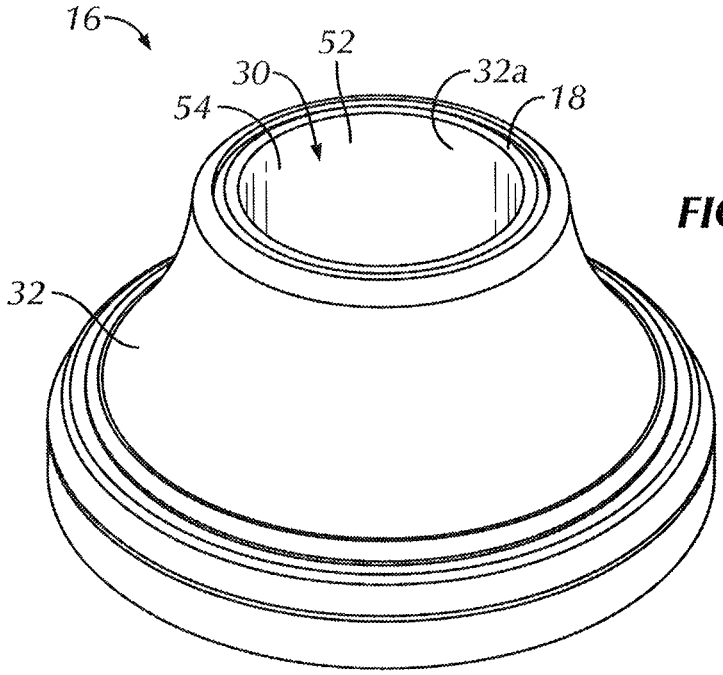
FIG. 4 is a perspective elevational view of an end cover of the curtain rod assembly shown in FIGS. 1-3A.

Referring to FIG. 4, the cover 16 is preferably configured as a decorative body 32. The body 32 is preferably frustum shaped, such as frustroconical. However, the body 32 can alternatively be of any geometrical configuration, e.g., frustropyramidal, etc. Further, it will be understood by those skilled in the art that the present invention is not limited to the outward appearance of the body 32 of the cover 16 as shown in the figures and as described herein. Rather, the body 32 may have any desired appearance to suit the different aesthetic preferences of different users.

Referring to FIGS. 4, 6-6A and 8-8A, the cover 16 has a first (or proximal) end 30 and an opposing second (or distal) end 28. The first and second ends 30, 28 are each preferably a generally open end, meaning each end preferably includes at least an opening formed therethrough. More preferably, each of the first and second ends 30, 28 includes a centrally-located open portion. Most preferably, each of the first and second ends 30, 28 is a completely open end.

Preferably, the cover 16 includes an inner wall 18 extending between the first end 30 and the second end 28. More preferably, the inner wall 18 extends in a lengthwise direction along a longitudinal axis $X_3$ of the cover 16. The longitudinal axis $X_3$ of the cover 16 extends from the first end 30 toward the second end 28 and is parallel to the longitudinal axis $X_1$ of end cap 14.

Preferably, the inner wall 18 extends from the first end 30 of the cover 16 toward the second end 28 and is positioned within an interior 32*a* of the cover body 32. More preferably, at the first end 30 of the cover 16, a portion of the body 32 transitions into the inner wall 18 which extends to the second end 28. The inner wall 18 is preferably configured so as to form a cavity 54 sized and shaped to receive at least a portion of one of the end caps 14 therein. The inner wall 18 preferably has a generally cylindrical or tubular configuration, such that a generally cylindrical or tubular cavity 54 is formed within an interior of the tubular wall 18. However, it will be understood that the inner wall 18 and the cavity 54 may have any appropriate shape which complements the shape of the portion of the end cap 14 to be received within the cavity 54.

The cavity 54 preferably has an open first end 52, which corresponds to (i.e., is positioned at) the first end 30 of the cover 16, and an opposing open second end 50, which corresponds to (i.e., is positioned at) the second end 28 of the cover 16. That is, the first and second ends 52, 50 of the cavity 54 preferably form open portions of the first and second ends 30, 28 of the cover 16.

Figure 8:
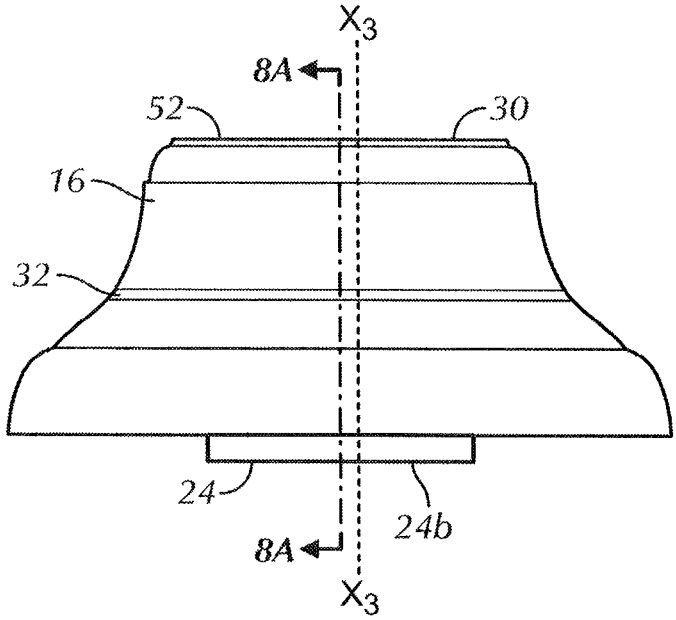
FIG. 8 is a front elevational view of the end cap of FIG. 7A assembled with the end cover of FIG. 4 in accordance with a preferred embodiment of the present invention.
Figure 8A:
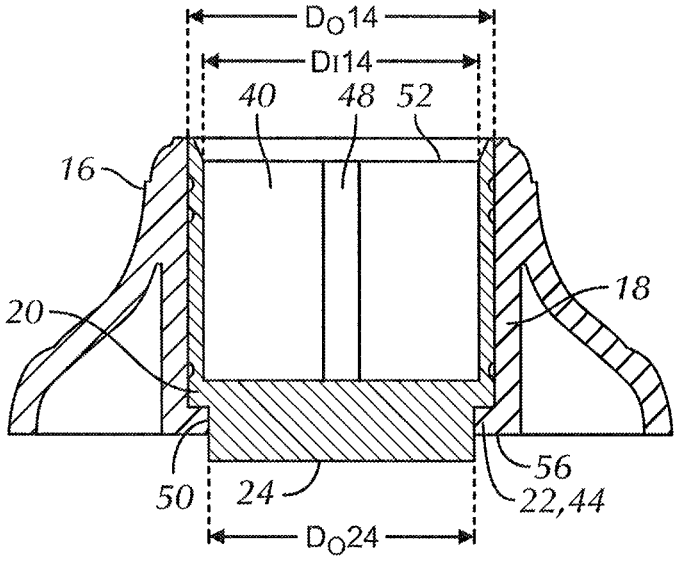
FIG. 8A is a cross-sectional elevational view of the end cap and end cover of FIG. 8 taken along line A-A.

More particularly, the cavity 54 preferably has a diameter that is at least slightly smaller than the overall outer diameter $D_{O14}$ of the end cap 14, such that the cover 16 can be easily assembled or positioned onto the end cap 14 but a tight friction fit is still achieved between the end cap 14 and the cover 16. Alternatively, the cavity 54 may be sized to have a slight interference fit with the overall outer diameter $D_{O14}$ of the end cap 14 so as to provide a snug fit upon assembly or may be configured with a tapered fit that engages a corresponding taper formed on the end cap 14. Additionally, the cover 16 is preferably sized and shaped such that the first end 30 sits flush with the open first end 24 of the end cap 14, as shown in FIGS. 6A and 8A, when the end cap 14 is received and positioned within the cavity 54.

At the second (distal) end 50 of the cavity 54, the inner wall 18 is preferably formed as a second step or stop 22 which cooperates with the first stop 20 of the end cap 14. More particularly, at the second (distal) end 50 of the cavity 54, the inner wall 18 preferably extends radially inwardly toward the interior cavity 54 of the cover 16 to form an annular flange 56. The flange 56 preferably extends around an interior periphery of the cavity 54. More preferably, the stop 22 is configured as an interior circumferential flange 56 which defines the open second end 50 of the cavity 54. The open second end 50 of the cavity 54 thus has a diameter which is at least slightly smaller than the diameter of the remainder of the cavity 54.

Preferably, the internal peripheral flange 56 of the cover 16 extends radially inwardly to an extent sufficient to ensure that the internal peripheral flange 56 engages the external peripheral groove 44 of the end cap 14. As such, the internal peripheral flange 56 of the cover 16 and the external peripheral groove 44 of the end cap 14 are cooperating structures that releasably hold the cover 16 in place at the correct position on the end cap 14. More preferably, the internal peripheral flange 56 of the cover 16 extends radially inwardly to an extent sufficient to allow the closed end 24 of the end cap 14 to extend through the open second end 50 of the cavity 54, but to prevent the remainder of the end cap 14 from passing therethrough.

In the fully assembled position of the rod assembly 10, each distal end of the rod 12 is positioned within the recess 40 of a respective end cap 14. Referring to the embodiment shown in FIGS. 5-6A, each distal end of the rod 12 is preferably proximate the interior surface 24*a* of the closed end 24 of the end cap 14, and more preferably engages or directly contacts the interior surface 24*a* of the closed end 24 of the end cap 14. Referring to the embodiment shown in FIGS. 7A-8A, each distal end of the rod 12 is preferably proximate the hub and spoke structure of the ribs 42, and more preferably engages or directly contacts the distal ends 42*a* of the plurality of ribs 42, such that the distal end of the rod 12 is spaced apart from the closed end 24 of the end cap 14.

Once each end of the rod 12 is positioned within a respective end cap 14, a cover 16 is assembled to each end cap 14, such as by sliding the cover 16 onto the respective end cap 14. More particularly, to place the cover 16 on the end cap 14, the cover 16 is preferably slid onto the end cap 14 with the open first end 30 of the cover 16 being a leading end and the open second end 28 of the cover 16 being a trailing end. As the cover 16 is slid onto the end cap 14 in this manner, the end cap 14 passes through the open first end 30 and is received and positioned within the cavity 54 of the cover 16. The cover 16 is considered to be fully assembled on the end cap 14 when the first end 30 of the cover 16 is preferably generally flush with the first end 26 of the end cap 14 and the interior stop 56 of the cover 16 engages or seats on the exterior groove 44 of the end cap 14. Also, when the cover 16 is fully assembled onto the end cap 14, the closed end 24 of the end cap 14 extends at least slightly beyond a plane defined by the second end 28 of the cover 16. As such, the closed end 24 of each end cap 14 is configured to bear against one of the two support surfaces 58, 60. At this stage, the rod assembly 10 is in the fully assembled position.

Thus, in order to assemble the rod assembly 10, and more particularly in order to position a cover 16 on each distal end of the rod 12, there is no need to first remove the end cap 14. Instead, because of the complementary dimensions and structures of the end cap 14 and the cover 12, the cover 12 can be easily positioned over the distal end of the rod with the end cap 14 positioned thereon.

Finally, the assembled rod assembly 10 may be positioned between two opposing support surfaces 58, 60 for mounting of a curtain, such as a shower curtain in a bathtub or shower stall (not shown). The assembly 10, with both ends of the rod 12 protected by the end caps 14 and the covers 16, is positioned between the opposing support surfaces 58, 60 of the stall and the length of the rod assembly 10 is adjusted until the desired overall length is achieved. Specifically, the length rod assembly 12 is adjusted by sliding the first and second tubular sections 34, 36 either toward or away from each other until a mounting length of the assembly 10 is achieved. The mounting length of the assembly 10 is dependent upon the distance between the opposing support surfaces 58, 60 and is achieved when the exterior surface 24*b* of the closed end 24 of each end cap 14 is proximate a respective opposing support surface 58, 60. More preferably, the mounting length of the rod assembly 10 is achieved when the exterior surface 24*b* of the closed end 24 of each end cap 14 directly contacts or engages, or almost directly contacts or engages, a respective opposing support surface 58, 60 at generally the same height, such that the first and second tubular sections 34, 36 are generally horizontal in the mounted configuration.

Finally, once the assembled rod assembly 10 is properly positioned between the two opposing support surfaces 58, 60, one of the tubular sections 34, 36 can be manually rotated by a user relative to the other of the tubular sections 34, 36, until the exterior surface 24*b* of the closed end 24 of each end cap 14 directly contacts, and more preferably presses upon, a respective opposing support surface 58, 60. More particularly, one of the tubular sections 34, 36 is manually rotated relative to the other, until the exterior surface 24*b* of the closed end 24 of each end cap 14 directly contacts a respective opposing support surface 58, 60, such that a compressive or tension force is generated by the rod assembly 10. In turn, the generated compressive force is applied or exerted against or upon the opposing support surfaces 58, 60 by the exterior surface 24*b* of the closed end 24 of each end cap 14. As such, the rod assembly 10 is maintained between the two opposing surfaces 58, 60 without the use of fasteners or adhesives.

Also, the cover 16 does not interfere with mounting of the rod assembly 10, as the closed end 24 of the end cap 14 protrudes slightly outwardly from the plane of the first end 28 of the cover 16. Further, the cover 16 is releasably held in position about the ends of the rod and the support surfaces 58, 60 by the secure engagement of the interior stop 56 of the cover 16 against the exterior groove 44 of the end cap 14.

In sum, the present invention advantageously provides for a cover 16 that can be assembled onto an end of a rod 12 without the need for removal of an end cap 14, while still enabling the end cap 14 to engage a wall surface and lock the cover 16 in position. Thus, a user can simply and easily assemble the rod assembly 10 by sliding the cover 16 onto the end of the rod 12 until the groove 44 of the end cap 14 and the stop 56 of the cover 16 are in engagement with each other and then mounting the assembled rod assembly 10. Furthermore, the present invention advantageously provides a locking mechanism that fixes the cover 16 about the ends of the rod 12 upon mounting of the rod assembly 10 between opposing support surfaces 58, 60.

It will be appreciated by those skilled in the art that changes could be made to the embodiment described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A rod assembly comprising:

a rod including a first rod section that is at least partially tubular and a second rod section that is at least partially tubular, the first rod section being telescopingly received with the second rod section, first and second end caps, each end cap having an open first end, an opposing generally closed second end, a sidewall extending therebetween, a recess defined by the sidewall and the generally closed end, and a groove which extends around an external periphery of the end cap proximate the generally closed second end, the recess of each end cap being sized and shaped to receive at least a portion of one of the first and second rod sections therein;

first and second covers, each cover having a general ly open first end, an opposing second end and a cavity extending therebetween, the cavity having an open first end, an open second end, and a flange which extends around an interior periphery of the cavity at the open second end of the cavity, the cavity of each cover being sized and shaped to receive at least a portion of one of the first and second end caps therein such that the external peripheral groove of the end cap engages the internal peripheral flange of the cover;

wherein the second generally closed end of the end cap protrudes outwardly from a plane defined by the second end of the cover, such that the second generally closed end of the end cap is configured to bear against a support surface.

2. The rod assembly according to claim 1, wherein the rod assembly is a tension-mounted rod assembly.

3. The rod assembly according to claim 1, wherein the recess of the end cap has a generally cylindrical configuration.

4. The rod assembly according to claim 3, wherein a diameter of the generally closed second end of the end cap is smaller than a diameter of the open first end of the end cap, the external peripheral groove being formed at a point where the end cap transitions to the smaller diameter of the generally closed second end.

5. The rod assembly according to claim 1, wherein an inner diameter of the recess of the first end cap differs from an inner diameter of the recess of the second end cap.

6. The rod assembly according to claim 1 , wherein the cavity of the cover has a generally cylindrical configuration 7. The rod assembly according to claim 1, wherein in an assembled position of the rod assembly, at least a portion of each of the first and second rod sections is received within a recess of a respective one of the first and second end caps such that each rod section directly contacts the generally closed second end of the respective end cap.

8. The rod assembly according to claim 1, wherein in an assembled position of the rod assembly, at least a portion of each of the first and second rod sections is received within a recess of a respective one of the first and second end caps such that each rod section is spaced apart from the generally closed second end of the respective end cap.

9. The rod assembly according to claim 1, wherein an interior of the sidewall of each end cap includes a plurality of longitudinally, radially inwardly extending protrusions.

10. A rod assembly comprising:

a rod including a first rod section that is at least partially tubular and a second rod section that is at least partially tubular, the first rod section being telescopingly received with the second rod section;

first and second end caps, each end cap having an open first end, a generally closed second end, a sidewall extending therebetween, a recess defined by the sidewall and the generally closed end, and at least one rib positioned within an interior of the recess between the open first end and the generally closed second end, the recess of each end cap being sized and shaped to receive at least a portion of one of the first and second rod sections therein such that a distal end of the rod section is proximate the at least one rib; and first and second covers, each cover having a generally open first end, a second end and a cavity extending therebetween, the cavity having an open first end and an open second end, the cavity being sized and shaped to receive at least a portion of one of the first and second end caps therein and the open second end of the cavity being sized and shaped to allow the generally closed second end of the end cap to pass therethrough and to prevent a remainder of the end cap from passing therethrough;

wherein the second generally closed end of the end cap protrudes outwardly from a plane defined by the second end of the cover, such that the second generally closed end of the end cap is configured to bear against a support surface.

11. The rod assembly according to claim 10, wherein the rod assembly is a tension-mounted rod assembly.

12. The rod assembly according to claim 10, further comprising a plurality of ribs arranged within an interior of the recess between the open first end and the generally closed second end in a hub and spoke configuration.

13. The rod assembly according to claim 12, wherein the hub is located at a geometric center of the generally closed second end of the end cap and the plurality of ribs extend radially outwardly away from the hub toward the sidewall of the end cap.

14. The rod assembly according to claim 10, wherein the at least one rib is attached to an interior surface of the generally closed second end.

15. The rod assembly according to claim 10, wherein the at least one rib is formed integrally with an interior surface of the generally closed second end.

16. The rod assembly according to claim 10, wherein the at least one rib is attached to an interior surface of the sidewall.

17. The rod assembly according to claim 10, wherein the at least one rib is formed integrally with an interior surface of the sidewall.

18. The rod assembly according to claim 10, wherein a groove extends around an external periphery of the end cap proximate the generally closed second end and a flange which extends around an interior periphery of the cavity at the open second end of the cavity, the external peripheral groove of the end cap being configured to engage the internal peripheral flange of the cover in an assembled position of the rod assembly.

19. The rod assembly according to claim 10, wherein in an assembled position of the rod assembly, at least a portion of each of the first and second rod sections is received within a recess of a respective one of the first and second end caps such that each rod section directly contacts the at least one rib of the respective end cap.

* * * * *